US007999211B2

(12) United States Patent
Ruiz et al.

(10) Patent No.: US 7,999,211 B2
(45) Date of Patent: Aug. 16, 2011

(54) HEATING ELEMENT STRUCTURE WITH ISOTHERMAL AND LOCALIZED OUTPUT

(75) Inventors: Orlando E. Ruiz, Rincon, PR (US); Patricia A. Beck, Palo Alto, CA (US); Janice H. Nickel, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1088 days.

(21) Appl. No.: 11/469,588

(22) Filed: Sep. 1, 2006

(65) Prior Publication Data

US 2008/0083744 A1 Apr. 10, 2008

(51) Int. Cl.

| | |
|---|---|
| ***B41J 2/05*** | (2006.01) |
| ***H05B 3/03*** | (2006.01) |
| ***H05B 3/16*** | (2006.01) |
| ***H05B 3/26*** | (2006.01) |

(52) U.S. Cl. ..... 219/539; 219/216; 219/541; 219/542; 347/62; 347/63

(58) Field of Classification Search ..... None
See application file for complete search history.

(56) References Cited

U.S. PATENT DOCUMENTS

| | | | | |
|---|---|---|---|---|
| 5,635,968 | A * | 6/1997 | Bhaskar et al. | 347/59 |
| 6,013,160 | A * | 1/2000 | Raisanen et al. | 204/192.15 |
| 6,169,275 | B1 * | 1/2001 | Noda et al. | 219/552 |
| 6,505,914 | B2 * | 1/2003 | Hofer et al. | 347/63 |
| 7,195,343 | B2 * | 3/2007 | Anderson et al. | 347/63 |
| 2006/0274125 | A1 * | 12/2006 | Jacobsen et al. | 347/61 |

* cited by examiner

*Primary Examiner* — Joseph M Pelham

(57) ABSTRACT

A microheater for heating at least one target area, the microheater comprising a substrate, a resistive material adjacent to the substrate and connector traces connected to the resistive material. The microheater is formed so that when a predetermined current flows through the resistive material, the target area is heated to a substantially isothermal temperature.

20 Claims, 2 Drawing Sheets

HEATING ELEMENT STRUCTURE WITH ISOTHERMAL AND LOCALIZED OUTPUT

BACKGROUND

Addressable heating element structures formed from resistive traces are used in a wide variety of applications including thermal ink jet (TIJ) printer heads, microelectronics, thermally assisted Magneto-resistive Random Access Memory (MRAM), actuation mechanisms for Microelectromechanical Systems (MEMS), operation of conglomerate pump systems and specialty devices such as that described in co-pending U.S. patent application Ser. No. 11/495,359, (which is hereby incorporated by reference in its entirety for all purposes) which may be used for drug delivery. The optimum heating profiles for each of these applications is different, requiring different designs.

Thin film heating structures are typically used in the microelectronic arena. Typically, multi-layer thin film heating structures are used for ink jet print heads, while thermally assisted MRAM may use either single or multi-layer thin film heating structures.

The multi-layer thin film heating elements used in thermal ink jet print heads are designed to reach an actuation temperature very quickly (within a few microseconds), maintain the actuation temperature for only a short period of time (a few microseconds), and then cool quickly. The objective is to heat rapidly in order to vaporize a substance, such as ink, and create a small gas bubble. The intention is to prevent heating more of the surrounding fluid than is necessary to generate the bubble and constrain the temperature increase to the area surrounding the bubble. As the bubble expands, some of the substance/ink is expelled from a holding chamber. Once the bubble collapses, capillary flow draws more of the substance/ink into the holding chamber from a reservoir. Once the ink is dispelled, the heater must be quickly cooled before the next expulsion, since simply holding the resistor at the high temperature does not expel more substance/ink. However, such rapid heating can have harmful cavitational effects to the surrounding materials, meaning that these heating systems are not necessarily effective or desirable for other applications.

Generally, single thin film heating elements are designed to heat either specific or indiscriminate areas for specific times to accomplish a predetermined objective. Often, when used for heating of target areas, existing TIJ or other heater structures will produce cross talk across adjacent target areas. This cross-talk will have the unintended consequences of heating the neighboring devices before actuation is desired. In applications such as MRAM or other arrayed devices unintended heating can have disastrous consequences for operation of the device. For example, if the structure is used in drug delivery applications, such as a microinjection device, unintended heating of adjacent wells could cause premature and inadvertent injection of the drug, possibly leading to adverse effects for the patient.

Moreover, as the area that is heated enlarges, whether or not such heating is intended, the power requirements increase. In battery operated devices, for example, unnecessary power consumption needlessly decreases the lifetime of the battery.

The ability to keep a desired area at a desired temperature while minimizing unwanted heating and thermal degradation is beneficial from the standpoint of operational efficiency, longevity and accuracy. Accordingly, there is a need for heating elements that are capable of producing a highly localized, predictable, and isothermal heating pattern.

DETAILED DESCRIPTION

Figure 1:
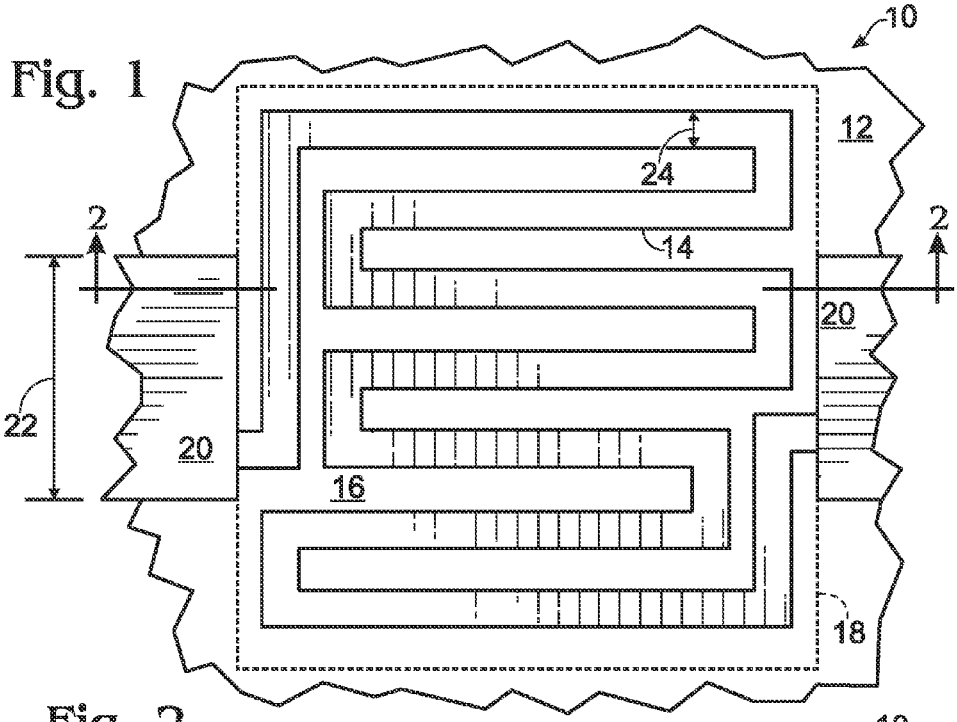
FIG. 1 is a top view of a heating element according to one embodiment of the present invention.

The present disclosure provides methods and systems for creating and maintaining highly localized, isothermal heating. FIG. 1 is a top view of one embodiment of a heating element 10 according to an embodiment. According to one embodiment, heating element 10 may take the form of a microheater suitable for use in a wide variety of applications, systems, and devices including, but not limited to MEMS, MRAM, conglomerate pump systems and the like.

As shown, FIG. 1 depicts a substrate 12 adjacent to which is formed a resistor trace 14. Resistor trace 14 may be formed by patterning a resistive material adjacent to substrate 12. Those of skill in the art will be familiar with various methods by which resistive material may be formed adjacent to a substrate so as to create a resistor trace. For example, the resistive material may be formed using known deposition techniques including, but not limited to sputtering, evaporation, plating, chemical vapor deposition, molecular beam epitaxy and combinations thereof. Moreover, according to one embodiment, rather than depositing the resistor trace on an inflexible substrate, the resistor could be deposited on a flexible substrate, such as a flex circuit which could then be adhered or attached to or otherwise associated with any desired surface. Additionally the resistive trace could be suspended through or elevated in a confined area.

Substrate 12 may be any suitable material or combination of materials including, for example, fused silica, quartz glass, plastic, or ceramic. An example of a suitable plastic is Polyethylene terephthalate (PET). Examples of suitable ceramics include Borosilicate glass and Macor® ceramic glass (available from Corning, Inc., Corning, N.Y.).

In the embodiment depicted in FIG. 1, the resistor trace is formed as a long, thin, line of resistive material patterned in a serpentine configuration. It will be appreciated, however, that numerous resistor patterns are possible and the suitability of a particular pattern may be dependant upon the materials used, the shape of the target area, the intended application, and various other factors. In the depicted embodiment, the serpentine-patterned resistor trace extends over a target area 16, the boundaries of which are defined by dotted line 18.

For the purposes of the present description, the term "target area" shall refer to an area that must be heated by the heating element in order to bring about an intended effect. For example, one possible application of the heating element of the present disclosure is for use in specialty injection devices such as those described in co-pending U.S. patent application Ser. No. 11/001,367 and in co-pending U.S. patent application Ser. No. 11/495,359, each of which is hereby incorporated by reference in its entirety for all purposes. According to some applications, specialty injection devices include a plurality of chambers, each of which is associated with an individually addressable heating element. When it is desired to effect expulsion of a material, such as a drug, injectate, fluid, or other substance, from the chamber, the heating element associated with a specific chamber is activated and the chamber (or some other structure, depending on the specific mechanism being used) is heated to a threshold temperature. Heating of the chamber (or other structure) to the threshold temperature effects expulsion of the material through an associated orifice, such as a microneedle, and into the recipient, which may, for example, be a body, apparatus, chemical system, etc. Accordingly, if the heating element shown in FIG. 1 is used in a specialty device as described above, the target area is the specific region of the device that must be heated to a specific temperature in order to effect expulsion of the material. Depending on the design of the device, this may be the chamber, a fluid barrier, an intermediate delivery chamber, or some other element of the device.

Accordingly, the target area may be a flat surface, well, chamber, or the like and the heating element is typically attached or otherwise thermally connected to the target area. Depending on the intended use and desired design, none, some, or all of the target area may be formed by substrate 12.

Still referring to FIG. 1, it can be seen that a connector trace 20 extends from each end of the resistor trace. The connector traces may be formed using known techniques including, for example, sputtering, evaporation, plating, chemical vapor deposition, molecular beam epitaxy, or combinations thereof. According to one embodiment of the present disclosure, the cross-sectional area of each of the connector traces is substantially larger than the cross-sectional area of the resistor trace. Accordingly, for a given thickness in the depicted embodiment, it can be seen that connector traces 20 are considerably wider than the resistor trace (compare arrows 22 and 24). As non-limiting examples, a given connector trace may be two or more times as wide, more than four times as wide, or more than eight times as wide as a corresponding resistor trace.

Figure 2:
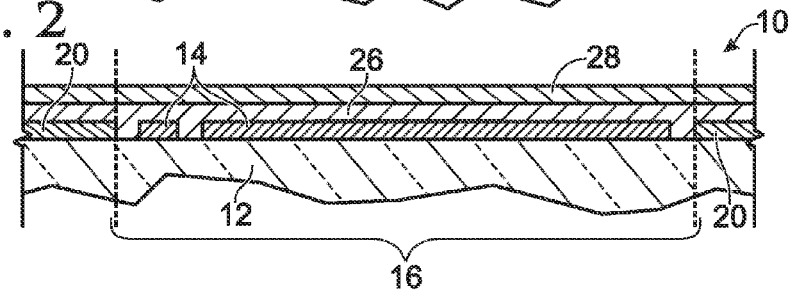
FIG. 2 is a cross-section of the heating element of FIG. 2 taken along line 2-2.

Turning now to FIG. 2, which is a cross-sectional view of the heating element of FIG. 1 taken along line 2-2, it can be seen that in this particular embodiment, the resistor trace 14 and connector traces 20 have the same thickness. However, it should be appreciated that, as described in greater detail below, alternate embodiments of the heating element may include resistor and connector traces having different thicknesses.

As also shown in FIG. 2, heating element 10 may include a passivation layer 26. The passivation layer 26 prevents corrosion and/or damage to the conductive components (e.g. resistor trace 14 and connector traces 20) of heating element 10 and may be formed as a single blanket layer over a wide area or may be patterned adjacent to only the conductive components. Those of skill in the art will be familiar with materials that are used to form passivation layers for heating elements. Examples of suitable materials that may be used to form a passivation layer 26 include silicon nitrides, silicon dioxides, silicon oxides, silicon oxynitrides, silicon carbides, resistive diamond like carbon, as well as metals such as tantalum, and vanadium.

Heating element 10 may further include a diffusive layer 28. The diffusive layer acts as a heat spreader and may be formed as a blanket layer extending across the entire substrate. However, the diffusive layer 28 may be formed only over the target area or the portions thereof where heat is required to be spread uniformly. Those of skill in the art will be familiar with materials that are used to form diffusive layers in heating elements. Examples of suitable materials that may be used to form a diffusive layer include silicon nitrides, silicon oxides, silicon carbides, and silicon oxynitrides.

Of course, FIG. 2 presents only one possible structure for a heating element according to the present disclosure and that various structural modifications are possible without departing from the scope of the present disclosure. For example, an additional layer or layers may be formed between the substrate and the resistor/connector traces, or not included at all. Moreover, heating element 10 may be formed without one or both of the passivation and diffusive layers. Furthermore, the same material may serve as both a diffusive layer and a passivation layer, and example of such a material would be electrically resistive diamond like carbon (DLC).

According to some embodiments, the heating element may include one or more vias. For example, a conductive layer may contact a resistive layer through the passivation layer by way of a via. Alternatively or additionally, the conductor traces may contact the resistor traces through vias through the substrate.

It should be appreciated that the heating elements described in the present disclosure may be used in a wide variety of applications including, for example, MEMS, MRAM and the like. According to some of these applications, the target area may need to reach or exceed a certain temperature defined as the "threshold temperature") before the device in which the heating element is used is able to bring about the intended result (e.g. allow a specific chemical reaction to take place, effect injection, etc.). Similarly, it will be understood that the target areas will typically have a desired baseline temperature. The baseline temperature is typically the temperature at which the target areas are maintained until the heating element is activated. This temperature will vary with the intended application of the device in which the heating element is incorporated and may be, for example, at or around room temperature (~22° C.), at or around body temperature (~37° C.) or significantly above or below these temperatures, depending on the desired application. Accordingly, a device will typically have an acceptable temperature range that spans from the baseline temperature to at least the threshold temperature. Moreover, according to some embodiments, the heating device of the present disclosure may be used to maintain an artificial baseline temperature.

According to one embodiment, the physical characteristics of the heating element including, but not necessarily limited to, the materials used to form the various components (e.g the resistor trace, the substrate, the connector traces) and the specific shapes thereof, are selected such that the heating element produces an isothermal temperature that is localized to a specific target area.

In general, an area is considered to be isothermal when the temperature distribution in the area is uniform. Of course, it will be appreciated that it may not be possible to achieve 100% uniformity across the entire area when it is also desirable to provide a localized heated temperature. Accordingly, for the purposes of the present disclosure, the term "substantially isothermal temperature" is meant to mean that at least 90% of the heated target area varies in temperature by less than 10% of the acceptable temperature range and 99% of the region varies in temperature by less than 20% of the acceptable temperature range and 100% of the target area varies in temperature by less than 50% of the acceptable temperature range.

Figure 3:
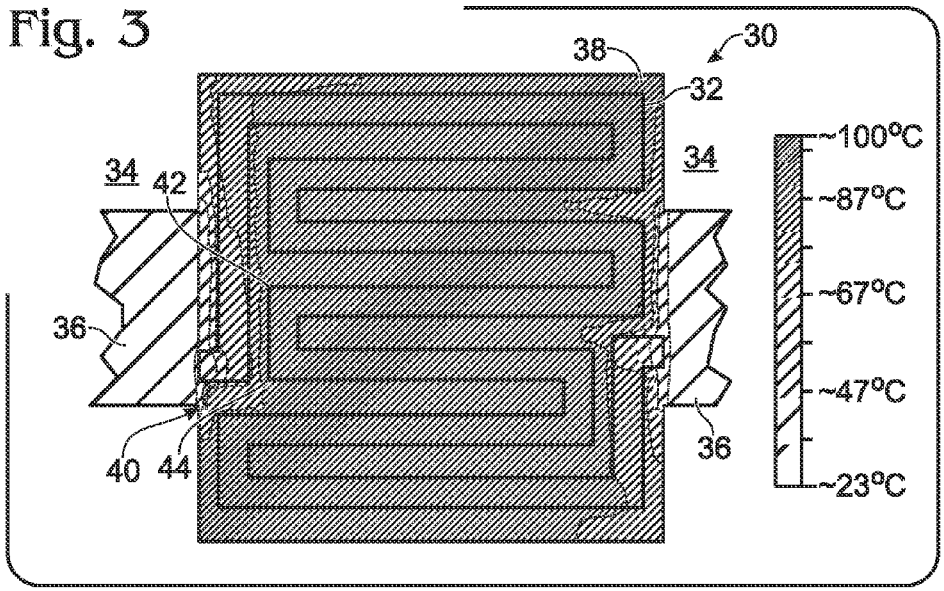
FIG. 3 depicts the temperature profile of the heating element of FIGS. 1 and 2.

FIG. 3 depicts a localized, isothermal temperature profile produced by a computer-modeled heating element 30. The heating element that produced this temperature profile was modeled to include a serpentine-shaped tungsten resistor 32 patterned over a target area 38 on a silica substrate 34. The resistor trace width was 60 μm and the resistor trace thickness was 0.25 μm. The 0.5 μm thick pads (not shown) were formed from gold and patterned in 500 μm×500 μm squares. The connector traces 36 were 400 μm wide and 0.25 μm thick and were made of tungsten. A silicon nitride passivation layer (also not shown) was formed adjacent to the metal traces at a thickness of 0.25 μm. The pad to pad resistance at 1.0 V was 37.1Ω and the current at 1.0 V was 27.0 mA.

The depicted heating element may be suitable, for example, in a drug delivery application wherein the baseline temperature is around 27° C. and the threshold temperature is around 95° C. As shown by the various cross-hatching patterns in FIG. 3 (the legend for which is shown at the far left side of the Figure), the temperature profile of the target area 38 incorporates a small area ~1% of the region, having a temperature around 57° C., a larger portion, ~10% having a temperature between 57° C. and 84° C. and the remaining ~90% having a temperature that is between 95° C. and 100° C.

Of course it will be appreciated that the heating element of the present invention may be suitable for use in devices having a wide range of baseline and threshold temperatures and that nothing in the above example is intended to limit the temperature range capabilities of the presently-described heating element. Furthermore, it should be understood that the heating element shown in FIGS. 1-3 depicts just one exemplary connector trace/resistor trace configuration that produces a substantially isothermal temperature profile.

In the example shown in FIGS. 1-3, the heating element includes connector and resistor traces formed from the same material and having cross-sectional areas that differ only in width. Alternatively, it may be possible to achieve an isothermal temperature profile by using connector and resistor traces formed from the same material and having cross-sectional areas that differ only in width, only in thickness, or in both width and thickness.

It should be appreciated, however, that it may be possible to achieve an isothermal temperature profile by using connector and resistor traces formed from different materials and having cross-sectional areas that differ only in thickness, only in width, or in both width and thickness.

Furthermore, while the depicted target areas are shown as being square, it should be understood that a given target area may be any desired shape or size, including for example, circular or rectangular. Moreover, it should be understood that arrangements for the resistor trace other than the depicted serpentine design may be utilized and that the appropriate resistor trace arrangement, whether serpentine or not, may be dependant upon a variety of factors including, for example, the size and shape of the target area, the desired heating pattern, the number and size of heating elements used to heat the target area, and any other suitable factors.

For example, it is believed that the isothermal nature of the heating profile in FIG. 3 could be improved on the left side by moving the connector trace-to-resistor trace junction 40 north (up on the page) and extending the $4^{th}$ and $5^{th}$ lateral resistor bends (42, 44) west (left on the page) so as to provide a resistor that is symmetric with 180° rotation. It is believed that by making these slight alterations to the resistor geometry, the areas of slightly decreased temperature at the left junction would diminish to mirror the slightly flatter and hotter profile on the right.

As stated above, the temperature profile of one embodiment of a heating element of the present disclosure produces not only an isothermal temperature, but also a localized temperature. For the purposes of the present disclosure, the term "localized" is used to mean that the temperature of the areas adjacent to the target area being heated maintain a temperature that is substantially closer to the baseline temperature of the device than the threshold temperature and does not substantially extend from those areas.

Still viewing FIG. 3, it can be seen that the areas of the connector traces that are closest to the resistor trace are around 42° C., which is substantially cooler than the temperature of the resistor trace, and much closer to the baseline temperature of the device (i.e., ~27° C.) than the threshold temperature (100° C.).

According to one embodiment, under normal operating conditions, when a first heating element as described herein is activated in order to heat a first target region, the temperature of any adjacent target regions is not adversely affected by heat generated from the activated heating element. For the purposes of the present disclosure, a target region is "adversely affected" if the target region, or any matter contained within the target region, is rendered unsuitable for its intended purpose or subjected to any unintended action or result (e.g. unintended ejection from a drug delivery device, alteration of chemical properties, etc.)

Figure 4:
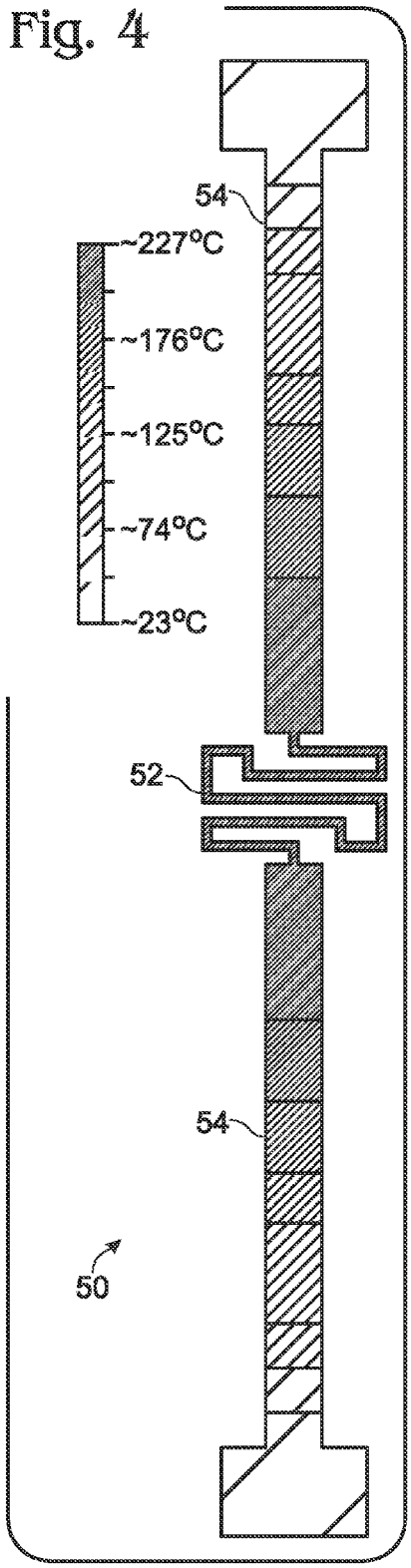
FIG. 4 depicts the temperature profile of a microheater that does not produce a localized heating pattern.

For comparison, the temperature profile of a heating element that is not producing a localized temperature profile is shown in FIG. 4. As shown, this heating element 50 has a distributed heating profile, where the temperature increase extends beyond the resistor 52 and extends significantly along the connector traces 54. In contrast, it can be seen that heating element 30 in FIG. 3 produces a sharp temperature drop between the resistor trace 32 and the connector traces 36.

Figure 5:
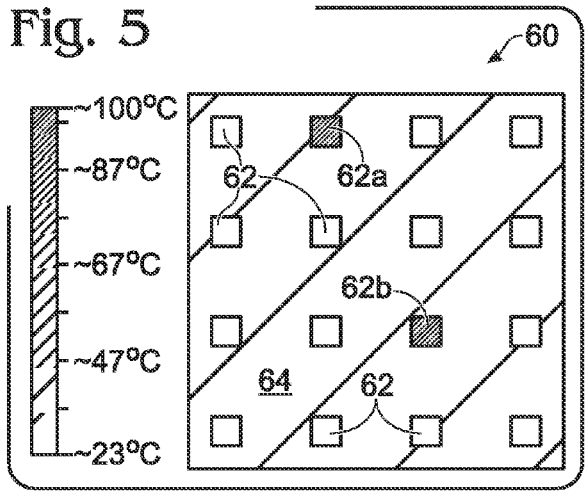
FIG. 5 is a schematic representation of an addressable array of heating elements according to an embodiment of the present invention.

FIG. 5 is a schematic showing an addressable array 60 of heating elements according to one embodiment of the present invention. The array includes a plurality of discrete target areas 62 on a substrate 64 wherein each discrete target areas is associated with a heating element. An exemplary temperature profile of the array is shown by the various stippling patterns. The array of FIG. 5 is shown to have an acceptable temperature range that extends from a baseline temperature (far apart stippled pattern) up to a threshold temperature (close together stipple pattern). As shown, the heating elements in the addressable array are configured such that when a first heating element, such as that associated with target area 62*a* or 62*b* is raised to the threshold temperature, the temperature of the substrate adjacent to the heated target area as well as any adjacent target areas is maintained at a temperature that is substantially closer to the baseline temperature of the device than to the threshold temperature of the device.

According to one embodiment, the heating device of the present disclosure is configured such that, when activated, the heat generated by the microheater associated with a first target area will not substantially affect the temperature profile of a second target area, where the second target area is separated from the first target area by a distance that is at least two times the width of the target areas. For example, if each of the target areas is approximately 1 mm wide, and the two target areas are separated by a 2 mm gap, the heat generated by a heating device that is associated with the first target area should not substantially affect the temperature profile of the second target area.

Returning to FIG. 2, the materials used to form heating element 10 may be particularly selected in order to produce the localized, isothermal heating pattern. Accordingly, in one embodiment, substrate 12 may be formed from a material that has a low thermal conductivity. As a non-limiting example, the substrate may be formed from glass, silica, plastic, or ceramic. An example of a suitable plastic is (PET). Examples of suitable ceramics include Borosilicate glass and Macor® from Corning, Inc. (Corning, N.Y.).

Alternatively or additionally, substrate 12 may include thermal barriers that are configured to reduce or eliminate thermal transfer from one section of the substrate (e.g. from one target area) to another. It should be appreciated that substrate 12 may be a monolayer of material or may be formed from several layers of the same or different materials. Furthermore, substrate 12 may have any desired thickness.

For example, substrate 12 may be between 50 and 1000 μm. As described above, substrate 12 may further retain properties or include layers which allow the substrate to act as a passivation layer and/or a diffusive layer. As a specific example, the heating element that produced the temperature profile shown in FIG. 3 included a substrate formed from Corning 7980 UV grade fused silica having a thickness of 500 μm.

Resistor trace 14 is typically formed from a resistive, thermally conductive material such as a metal or a conductive polymer. According to one embodiment, resistor trace 14 is formed from a material having a resistance between 1 E-08 Ω-m and 1 E-09 Ω-m and having a thermal conductivity between 100 W/m-K and 200 W/m-K and is more preferably formed from a material having an electrical resistivity between 4 E-08 Ω-m and 7 E-08 Ω-m and a thermal conductivity between 125 W/m-K and 175 W/m-K. For example, the heating element that produced the temperature profile shown in FIG. 3 included a resistor trace formed from Tungsten, which has a resistivity of 5.3 E-08 Ω-m and a thermal conductivity of 163.3 W/m-K. Non-limiting examples of materials that are suitable for use as resistor traces include tungsten, tantalum aluminum (TaAl), titanium (Ti), chromium (Cr), tantalum (Ta) and combinations thereof.

Resistor trace 14 may have any suitable cross-sectional aspect ratio. For example, the heating element that produced the temperature profile shown in FIG. 3 included a resistor trace that was patterned to have a thickness of 0.25 μm and a width of 60 μm. According to one embodiment, resistor trace 14 may be patterned above substrate 12 using standard techniques.

Connector traces 20 are typically formed such that they possess a lower electrical resistivity and higher thermal conductivity than the resistor trace. This may be achieved by the use of different materials and/or different geometrical formations. For example, the heating element that produced the temperature profile shown in FIG. 3 included connector traces formed from the same materials as the resistors, but of a different width. Non-limiting examples of materials that are suitable for use as connector traces include tungsten, TaAl, Ti, Cr, and combinations thereof.

The distal end of each connector trace 20 may lead to a contact pad. For example, the heating element that produced the temperature profile shown in FIG. 3 included pads formed from gold.

As stated above, according to some embodiments, the cross sectional area of connector traces 20 is significantly larger than the cross sectional area of the resistor trace 14. In the embodiment depicted in FIG. 2, the connector traces and resistor trace have the same thickness, but the connector traces are significantly wider than the resistor trace. As a specific example, the heating element that produced the temperature profile shown in FIG. 3 included connector traces having a thickness of 0.25 μm (the same thickness as the resistor trace) but a width of 400 μm (compared to 60 μm for the resistor trace), producing a greater than 1:6 resistor trace to connector trace cross-sectional area ratio.

It should be understood that the desired differential between the resistor trace cross-sectional area and the connector trace cross-sectional area will depend upon the specific materials used and desired heating parameters. However, it is believed that cross-sectional area ratios of between 1:5 and 1:10 (resistor trace: connector trace) may be within a suitable range for numerous applications.

Figure 6:
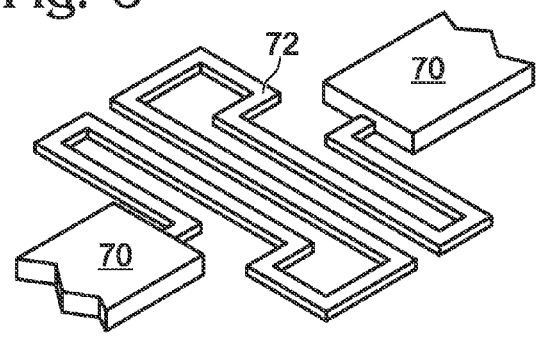
FIG. 6 is a plan view of a heating element according to another embodiment of the invention.

While the embodiments depicted in FIGS. 2 and 3 create the cross sectional area differentials by providing a connector trace that is wider than the resistor trace (with the same thickness), another embodiment, such as that shown in FIG. 6, produces a cross sectional area differential by providing connector traces 70 that are both thicker and wider than the resistor trace 72. Accordingly, it may be possible to produce results similar to those shown in FIG. 3, by forming connector traces that have a different aspect ratio but the same cross sectional area from the connector traces shown in FIGS. 2 and 3, (e.g. cross sectional area>1:6 resistor trace: connector trace). For example, assuming everything else to be the same, it is believed that a heating element including a 0.25 μm×60 μm resistor and 0.5 μm×200 μm connector traces would produce a similar heating profile as a heating element including a 0.25 μm×60 μm resistor and 0.25 μm×400 μm connector traces.

According to one embodiment, contrary to the types of microheaters that are typically used in thermal ink jet applications which produce a rapid temperature rise and then cool quickly (i.e. on the order of microseconds or even lower), the heating elements of the present disclosure may be used to produce a slow, sustainable, temperature rise with a sustainable peak temperature. For the purposes of the present disclosure, a slow temperature rise is considered one in which the threshold temperature is achieved in the order of 0.1-5 minutes. Similarly, a sustainable temperature is a temperature that can be maintained for at least one minute and which can be maintained for many minutes, without adversely affecting the localized nature of the heating profile. A slowly achieved sustainable temperature may be better suited for certain types of applications including some microinjection devices, biological heaters (smart Petri dishes), polymerization procedures and drug delivery applications.

It will be appreciated that the heating device of the present disclosure can use a multiple of heating profiles to accomplish the desired result. For example, the device can change the delivery voltage to change the time required to reach the thresh-hold temperature. Alternatively or additionally, the device can have an on/off/on profile, or a stepwise profile. Moreover, using lower voltages increases the delivery time, and decreases the delivery power. This may be advantageous when a slow delivery is desired.

While the invention has been described with reference to the exemplary embodiments thereof, those skilled in the art will be able to make various modifications to the described embodiments without departing from the true spirit and scope of the disclosure. Accordingly, the terms and descriptions used herein are set forth by way of illustration only and are not meant as limitations.

What is claimed is:

1. A microheater for heating at least one target area, the microheater comprising:

a substrate including the at least one target area;

a resist or trace formed adjacent to the substrate for heating the at least one target area of the substrate; and connector traces formed from a conductive material connected to the resistor trace;

wherein the resistor trace and the connector traces each have a predetermined cross-sectional area and configuration on the substrate so that when a predetermined current flows through the resistor trace, about 90% of the at least one target area of the substrate that is not directly adjacent to the connector traces is heated to a substantially isothermal temperature ranging from about 95° C. to about 100° C. and about 10% of the at least one target region of the substrate that is directly adjacent to the connector traces has a temperature ranging from about 57° C. to about 84° C., wherein a temperature of the connector traces is about 42° C.

2. The microheater of claim 1, wherein there are multiple target areas on the substrate heated by an addressable array, wherein a second target area is separated from the at least one target area by a distance that is at least two times a width of the at least one target area, and wherein when the predetermined current flows through the resistor trace, a temperature profile of a second target area is substantially unaffected.

3. The microheater of claim 1 further comprising a passivation layer adjacent to the resistor trace.

4. The microheater of claim 1 further comprising a diffusive layer adjacent to the resistor trace.

5. The microheater of claim 1 wherein the predetermined cross-sectional area of the resistor trace is X and wherein the predetermined cross-sectional area of each of the connector traces is between 5X and 10X.

6. The microheater of claim 1 wherein the resistor trace has a higher resistance than each of the connector traces.

7. The microheater of claim 1 wherein the resistor trace and the connector traces are formed of tungsten.

8. The microheater of claim 1 wherein the resistor trace has a thickness of between 0.2 μm and 0.3 μm, and the connector traces each have a thickness of between 0.1 μm and 0.6 μm.

9. The microheater of claim 1 wherein the resistor trace has a width of between 40 μm and 80 μm and the connector traces each have a width of between 200 μm and 600 μm.

10. The microheater of claim 1, wherein the substrate is formed from a material having low electrical conductivity and low thermal conductivity.

11. The microheater of claim 1 wherein a temperature of the connector traces and of the area of the substrate adjacent to and surrounding the connector traces is lower than the substantially isothermal temperature of the at least one target area.

12. The microheater of claim 11 wherein a temperature of the connector traces is isothermal.

13. An addressable array of microheaters, comprising:

a plurality of discrete target areas on a substrate; and respective heating elements positioned on each of the discrete target areas, each of the heating elements including:

a resistor trace formed from a resistive material; and connector traces formed from a conductive material and extending from the resistor trace;

wherein the resistor trace and the connector traces of each respective heating element each have a predetermined cross-sectional area and configuration on the substrate such that when a first discrete target area is heated via an adjacent resistor trace, the temperature of an adjacent discrete target area is maintained at a temperature closer to a baseline temperature of 22° C. to 30° C. than to a desired threshold temperature of 100° C. and at least 50° below the desired threshold temperature, and about 90% of the first discrete target area that is not directly adjacent to the connector traces is heated to a substantially isothermal temperature ranging from about 95° C. to about 100° C. and about 10% of the first discrete target area that is directly adjacent to the connector traces has a temperature ranging from about 57° C. to about 84° C., and wherein the second target area is separated from the first target area by a distance that is at least two times the width of the first target area.

14. The array of claim 13 wherein the array includes an electrical isolation element.

15. The array of claim 13 wherein a ratio of resistor trace cross-sectional area to connector trace cross-sectional area for each respective heating element is between 1:5 and 1:10.

16. The array of claim 13, further comprising a diffusive layer adjacent to each of the heating elements and the plurality of discrete target areas.

17. The array of claim 13, further comprising a passivation layer adjacent to each of the heating elements and the plurality of discrete target areas.

18. A method for addressably heating a first discrete target area in an addressable array of target areas of a substrate, the method comprising:

selecting a predetermined cross-sectional area and a configuration on the substrate for each of a resistor trace and a pair of connector traces that will extend from the resistor trace so that when a predetermined current flows through the resistor trace, about 90% of the first discrete target area that is not directly adjacent to the connector traces is heated to a substantially isothermal temperature ranging from about 95° C. to about 100° C. and about 10% of the first discrete target area that is directly adjacent to the connector traces has a temperature ranging from about 57° C. to about 84° C., wherein a temperature of the connector traces is at least 50° lower than the substantially isothermal temperature;

providing a plurality of microheaters, wherein each microheater is adjacent to the substrate, and wherein each microheater comprises:

the selected resistor trace patterned adjacent to the substrate and positioned adjacent to one of the target areas;

the selected pair of connector traces extending from the resistor trace; and a diffusive layer formed adjacent to the resistor trace; and flowing the predetermined current through the first resistor trace.

19. The method of claim 18 wherein each microheater further comprises a passivation layer.

20. A microheater for heating at least one target area, the microheater comprising:

a silicon substrate including the at least one target area;

a serpentine-shaped tungsten resistor trace patterned over the substrate for heating the at least one target area of the substrate, the resistor trace having a width of 60 μm and a thickness of 0.25 μm;

a respective tungsten connector trace connected to the resistor trace at opposed sides of the at least one target region, each of the connector traces having a width of 400 μm and a thickness of 0.25 μm; and a silicon nitride passivation layer formed adjacent to the resistor and connector traces, the silicon nitride passivation layer having a thickness of 0.25 μm;

wherein when a predetermined current flows through the resistor trace, the at least one target area of the substrate is heated to a substantially isothermal temperature, and a temperature differential between the at least one target area and an area of the substrate adjacent to and surrounding the connector traces is greater than or equal to 50° C., without substantially affecting a temperature profile of a second target area, wherein the second target area is separated from the at least one target area by a distance that is at least two times the width of the at least one target area.

* * * * *

UNITED STATES PATENT AND TRADEMARK OFFICE

CERTIFICATE OF CORRECTION

PATENT NO. : 7,999,211 B2
APPLICATION NO. : 11/469588
DATED : August 16, 2011
INVENTOR(S) : Orlando E. Ruiz et al.

It is certified that error appears in the above-identified patent and that said Letters Patent is hereby corrected as shown below:

In column 9, line 52, in Claim 13, delete "the second target" and insert -- a second discrete target --, therefor.

Signed and Sealed this
Twenty-seventh Day of November, 2012

David J. Kappos

David J. Kappos
*Director of the United States Patent and Trademark Office*